US010876776B1

(12) United States Patent
Senia et al.

(10) Patent No.: US 10,876,776 B1
(45) Date of Patent: Dec. 29, 2020

(54) SYSTEM AND METHOD FOR FREEZE PROTECTION OF AN AIR HANDLING SYSTEM

(71) Applicants: Robert Senia, Morganville, NJ (US); Christina Senia, New York, NY (US)

(72) Inventors: Robert Senia, Morganville, NJ (US); Christina Senia, New York, NY (US)

( * ) Notice: Subject to any disclaimer, the term of this patent is extended or adjusted under 35 U.S.C. 154(b) by 314 days.

(21) Appl. No.: 15/843,011

(22) Filed: Dec. 15, 2017

(51) Int. Cl.
*F25B 49/00* (2006.01)
*F25B 47/00* (2006.01)
*F25B 41/00* (2006.01)

(52) U.S. Cl.
CPC ..... *F25B 49/005* (2013.01); *F25B 41/00* (2013.01); *F25B 47/00* (2013.01); *F25B 2500/06* (2013.01); *F25B 2600/2515* (2013.01)

(58) Field of Classification Search
CPC ..... F25B 49/005; F25B 41/00; F25B 41/04; F25B 47/00; F25B 47/006; F25B 2500/06; F25B 2600/2515; F24F 11/30; F24F 11/41; F24F 11/42
See application file for complete search history.

(56) References Cited

U.S. PATENT DOCUMENTS

| | | | | |
|---|---|---|---|---|
| 4,800,371 | A | 1/1989 | Arsi | |
| 9,719,234 | B1 | 8/2017 | Christopher | |
| 2006/0168611 | A1 | 7/2006 | Fima | |
| 2014/0034145 | A1* | 2/2014 | Burt | F24F 11/83 137/59 |
| 2017/0138022 | A1 | 5/2017 | Trescott | |
| 2019/0264947 | A1* | 8/2019 | Reider | F24F 11/84 |

FOREIGN PATENT DOCUMENTS

| | | | |
|---|---|---|---|
| EP | 1130330 | A2 | 9/2001 |
| GB | 2496640 | A1 | 5/2013 |
| JP | H10-213346 | A1 | 8/1998 |
| JP | 2001004208 | A1 | 1/2001 |
| JP | 2004092100 | A1 | 3/2004 |
| JP | 2006016766 | A1 | 1/2006 |

(Continued)

OTHER PUBLICATIONS

Website printout dated Aug. 28, 2017 www.acurite.com/learn/home-monitoring/prevent-frozen-pipes-for-pools-and-hot-tubs#Water.

(Continued)

*Primary Examiner* — Joseph F Trpisovsky
(74) *Attorney, Agent, or Firm* — Keene IP Law, LLC

(57) ABSTRACT

An air handling system is provided and includes a coil in fluid communication with a water supply piping system and a water return piping system, a water supply piping system for returning the water from the coil to the water supply piping system, a circulating pump, and a control valve disposed in the water return piping system. The control valve controller can cause the control valve to open to a first predetermined position that is less than a fully opened position and modulate in response to a first temperature sensor sensing a temperature below a value such that the pressure drop in the coil and flow to the coil increases at sufficient values to protect against freezing of the water in the coil while also staying within a sufficient range to maintain authority of the control valve when the air handling system is either operating or not operating.

27 Claims, 8 Drawing Sheets

(56) References Cited

FOREIGN PATENT DOCUMENTS

| | | | |
|---|---|---|---|
| KR | 1020100136003 | A1 | 12/2010 |
| KR | 1020150030120 | A1 | 3/2015 |
| KR | 1020150042766 | A1 | 4/2015 |
| KR | 1020150093343 | A1 | 8/2015 |

OTHER PUBLICATIONS

Thomasson, Andreas, Modeling and Control of Co-Surge in Bi-Turbo Engines, 18th IFAC World Congress, Aug. 28-Sep. 2, 2011. Milano, Italy (6 pages).

* cited by examiner

SYSTEM AND METHOD FOR FREEZE PROTECTION OF AN AIR HANDLING SYSTEM

FIELD

This application relates to a system and a method for freeze protection of an air handling system.

BACKGROUND

A problem in designing air handling units that provide outside air into buildings is the possibility that water in the coils could freeze leading to a frozen or burst coil. A typical solution is to provide a freeze protection circulating pump at the coil in order to maintain flow to prevent a freezing condition.

When sizing any pump, flow and head are the required design parameters. Typically designers use the coil design parameters for their selection of the freeze protection pump. However, when designing a freeze protection system you also need to consider which mode of operation the unit is at and what position a control valve is in. These operation modes include an unoccupied mode in which the air handler is off and the control valve is closed, and an occupied mode in which the air handler is operating and the control valve is moving between the fully opened and fully closed position.

If the freeze protection pump only operated in unoccupied mode in which the control valve is closed, the pump could be sized based on known GPM and pressure drop values from the coil selection plus some additional small piping pressure drop. However, there are additional design constraints to consider in an occupied mode in which the pump is operating and the control valve is open. A control valve is selected in regards to the pressure drop across the coil. In order for the control valve to operate properly, the building system differential pressure needs to be approximately two times greater than the pressure of the water controlled by the control valve.

When in the occupied mode and the control valve is 100% open, the design flow (X) GPM is being delivered from the house pump to the coil. If the ambient temperature is below 35° Fahrenheit, the freeze protection pump is enabled and provides an additional (x) GPM to the coil. Under these conditions, enabling the freeze pump potentially doubles the design flow (2×) GPM, to the coil.

If the pump selected is oversized with a higher pressure drop than the actual coil and the freeze protection loop (a common problem due to the available circulator pumps), the pump will deliver even more than double the design flow (x) to the coil. By more than doubling the GPM to the coil, the pressure drop in the coil increases by a second order curve resulting in a much higher pressure drop (Pressure Drop At Flow (FTWG)=(Design Pressure Drop (FTWG)/(Design Flow GPM)2)×(New Flow GPM)2) which will cause a control authority problem for the control valve.

In essence, by increasing the pressure at the coil with an oversized pump, the building pumping system will need to pump in overdrive and provide an increased amount of pressure in order for the valve to maintain proper control authority. If the building's pumps cannot provide more pressure, the valve will lose control of the coil and cause problems in maintaining air temperature control. If the building pumps are able to overcome the addition pressure drop required, they will do so at the expense of energy, cost savings and added complexity to the system.

Further, in a typical sequence of operation, the pump is energized by an ambient temperature set point. This is one reference point that should be used for freeze protection, however ambient temperature alone should not enable the pump because freezing doesn't occur based solely on ambient temperature. Freezing is caused by water in the coil dropping below 32 degrees Fahrenheit.

Also, when a larger flow than the design flow (x) is delivered, pipe or tube erosion becomes a concern. The recommendation is to keep tube velocity below 8 fps. However, the increase in flow with an oversized freeze protection pump will exceed this velocity.

SUMMARY

In one aspect of the present invention, an air handling system is provided. The air handling system includes at least one coil, a water supply piping system in fluid communication with the coil for supplying water to the coil, and a water return piping system in fluid communication with the coil and water supply piping system for returning the water from the coil to the water supply piping system. The air handling system further includes a circulating pump that is in operative fluid communication with the water supply piping system and the water return piping system. The air handling system also includes a control valve. The control valve is disposed in the water return piping system and is configured for controlling the flow of water. The air handling system also includes a first temperature sensor that is configured for sensing temperature at a location. The air handling system also includes a controller that is in operative connection with the first temperature sensor and the control valve. The controller is configured to cause the control valve to open to a first predetermined position that is less than a fully opened position and modulate in response to the first temperature sensor sensing a temperature below a first predetermined value such that the pressure drop in the coil and flow to the coil increases at sufficient values to protect against freezing of the water in the coil while also staying within a sufficient range to maintain authority of the control valve when the air handling system is either operating or not operating.

In another aspect of the present invention, a freeze protection system for an air handling system is provided. The freeze protection system includes a water supply piping system for supplying water to at least one coil of the air handling system, and a water return piping system in fluid communication with the water supply piping system for returning the water from the coil to the water supply piping system. The freeze protection system further includes a circulating pump in operative fluid communication with the water supply piping system and the water return piping system, a control valve disposed in the water return piping system. The control valve is configured for controlling the flow of water. The freeze protection system also includes a controller in operative connection with the first temperature sensor and the control valve. The controller is configured to cause the control valve to open to a predetermined position that is less than a fully opened position and modulate in response to a first temperature sensor of the air handling system sensing a temperature at a location below a first predetermined value such that the pressure drop in the coil and flow of water to the coil increases at sufficient values to protect against freezing of the water in the coil while also staying within a sufficient range to maintain authority of the control valve when the air handling system is either operating or not operating.

In another aspect of the present invention, a method for protecting against freezing of a coil of an air handling system is provided. The method includes sensing a temperature at a location, determining whether the sensed temperature is below a first predetermined value, and in response to determining that the sensed temperature is below a first predetermined value, opening a control valve associated with the coil to a first predetermined position that is less than a fully opened position and modulating the control valve to control the flow of water in the coil such that the pressure drop in the coil and flow of water to the coil increases at sufficient values to protect against freezing of the water in the coil while also staying within a sufficient range to maintain authority of the control valve when the air handling system is either operating or not operating.

Other aspects of the disclosed system and a method for freeze protection of an air handling system will become apparent from the following detailed description, the accompanying drawings and the appended claims.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 1:
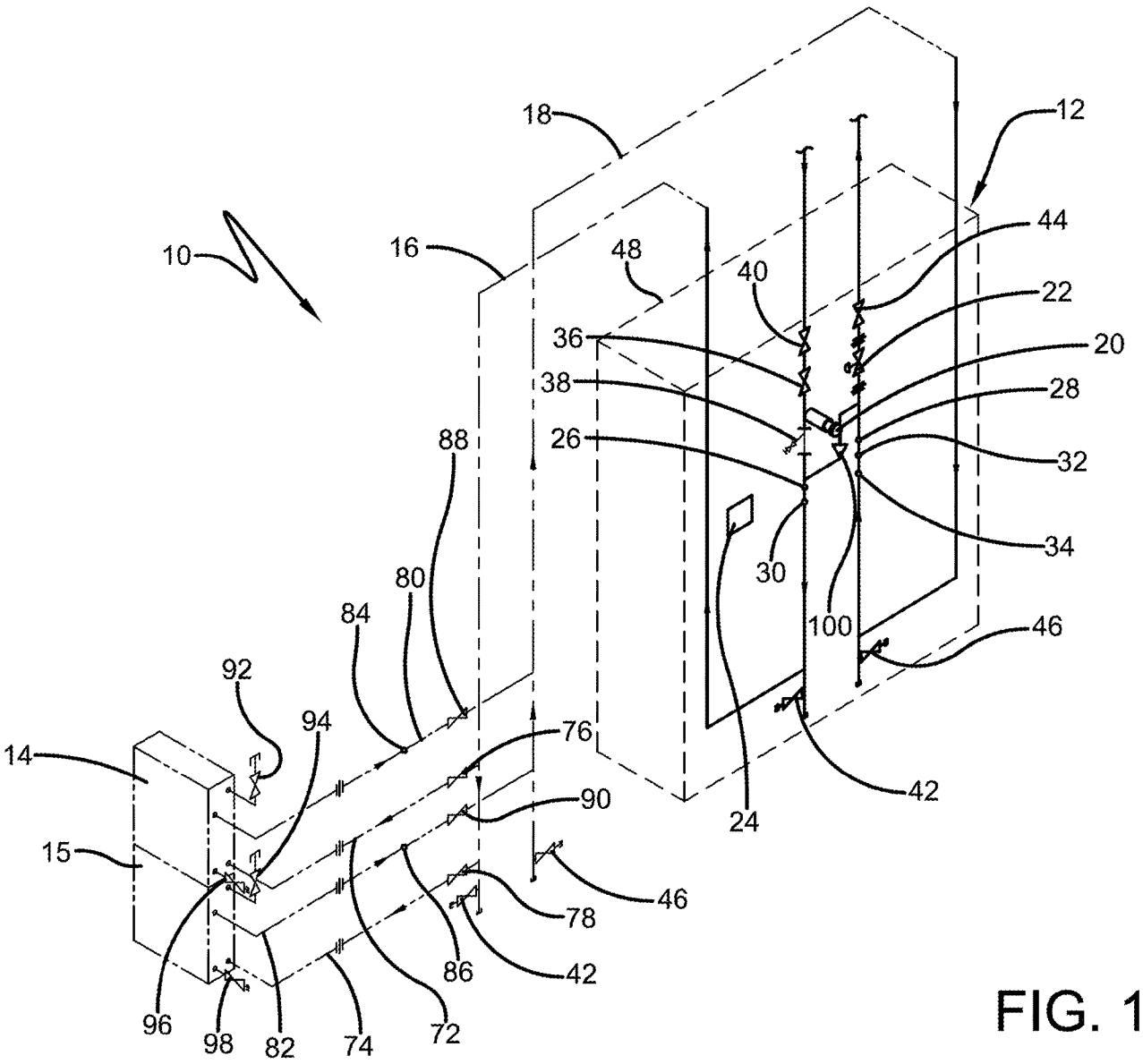
FIG. 1 is schematic view of the air handling system according to an embodiment of the invention.

FIG. 1 shows an air handling system 10 comprising a freeze protection system 12 that addresses the above-mentioned problem. The air handling system 10 may comprise one or more HVAC coils such as first and second coils 14, 15. Each coil may comprise copper tubes with copper or aluminum fins to aid heat transfer. Each coil may also employ eliminator plates to remove and drain condensate. The coils 14, 15 are in fluid communication with a common water supply pipe 16 and common water return pipe 18. The common water supply pipe 16 may supply either chilled water or hot water to the coils for air conditioning or heating, respectively.

The freeze protection system 12 may comprise a circulating pump 20, a control valve 22, a touch screen controller 24, a water supply temperature sensor 26, a water return temperature sensor 28, water supply pressure sensor 30, a water return pressure sensor 32, and a flow and temperature switch 34. The freeze protection system 12 may further include a balancing valve 36, a strainer with blow-off valve 38, a water supply shutoff valve 40, a water supply drain valve 42, a water return shutoff valve 44 and a water return drain valve 46. The freeze protection system 12 includes a housing 48 such as a cabinet that houses these components of the freeze protection system 12. The electric components of the freeze protection system may be powered by a suitable power source and equipped with any necessary low voltage transformers.

Figure 3:
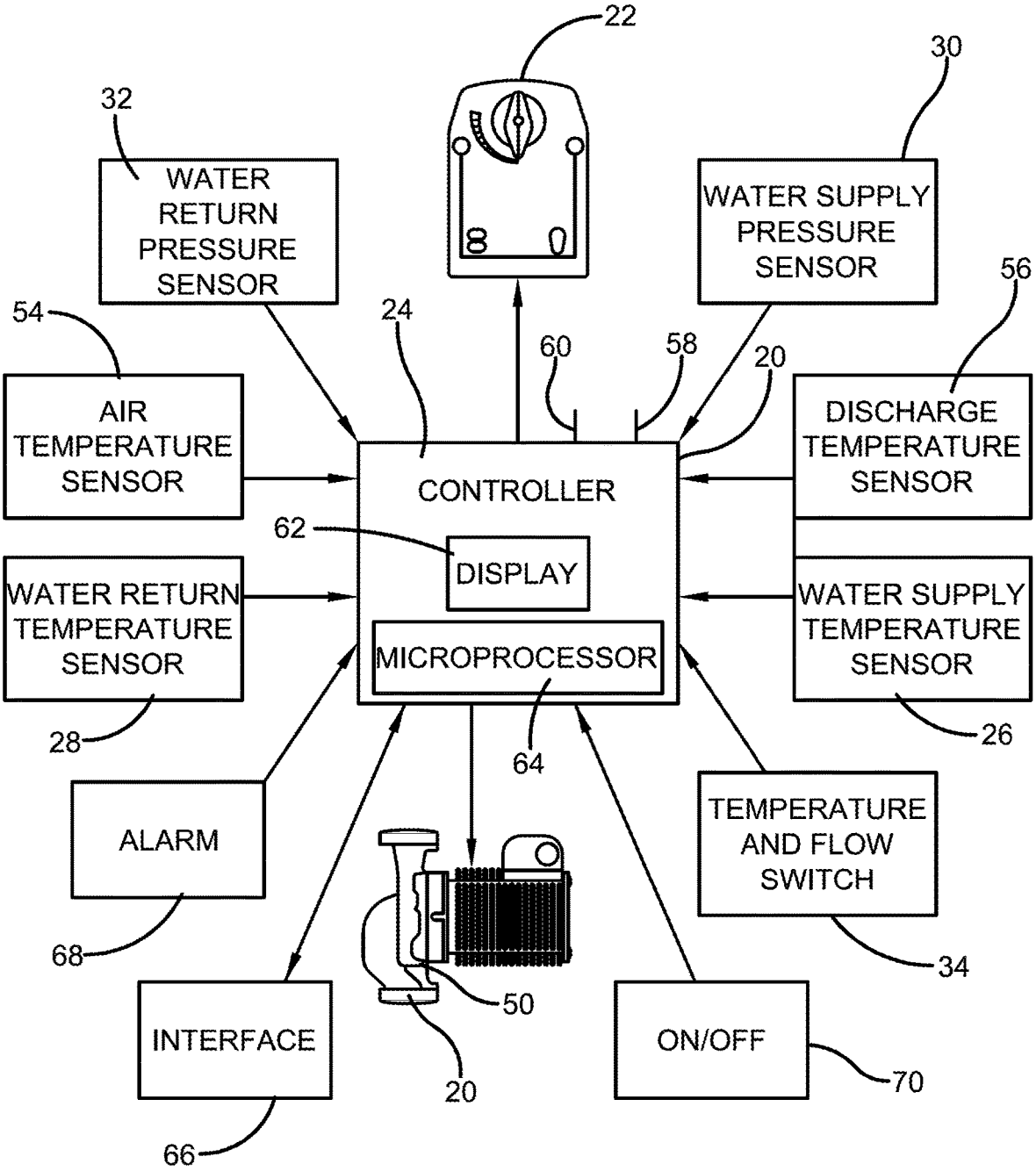
FIG. 3 is a block diagram of the controller operatively connected to other components of the air handling system of FIG. 1.

As illustrated in FIGS. 1 and 3, the circulating pump 20 may be a variable speed wet-rotor circulator pump. The circulating pump 20 may comprise a body 50 that is made of cast iron and stainless steel volutes and houses the motor and other components of the circulating pump. The circulating pump 20 may be configured to maintain 1 to 2 feet per second of coil tube velocity and a minimum coil tube velocity of 1 fps when the control valve is closed. The circulating pump 20 may be configured to have eight operation modes with an "Auto" algorithm, four sensorless modes, and three fixed speed modes. The circulating pump 20 is sized by selecting the flow and head to maintain the tube velocity at 1 fps, without any system pump input flow.

The balancing valve 36, if provided, is a ball type triple purpose balancing valve. The balancing valve 36 is calibrated for use as a presettable balance valve, variable orifice flow meter and positive shut-off service valve. The balancing valve 36 may be furnished with a memory stop indicator which permits a preset to a fixed open position and then closed for service without disturbing the valve setting. The balancing valve 36 may be equipped with capped readout valves fitted with internal check valves.

Figure 4A:
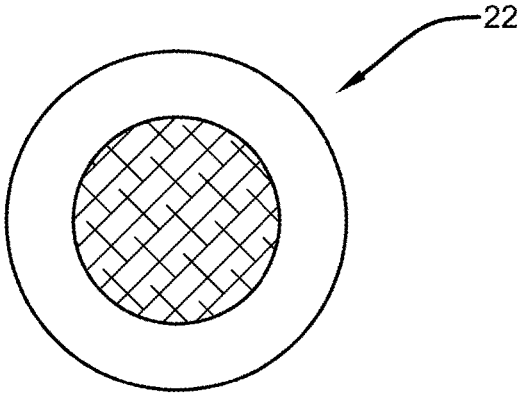
FIGS. 4A to 4D are axial end views of various positions of the control valve of the air handling system of FIG. 1.
Figure 4B:
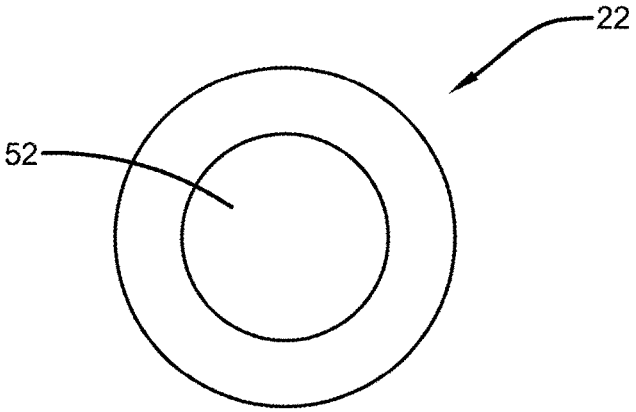
Figure 4C:
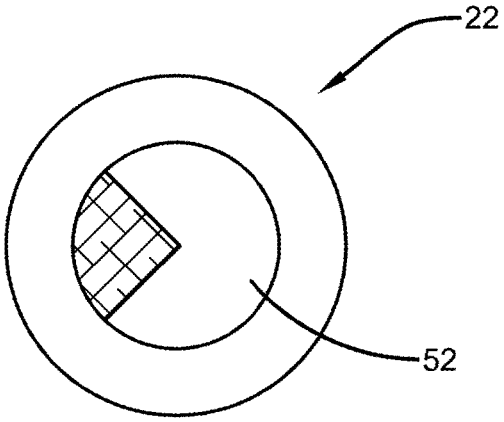
Figure 4D:
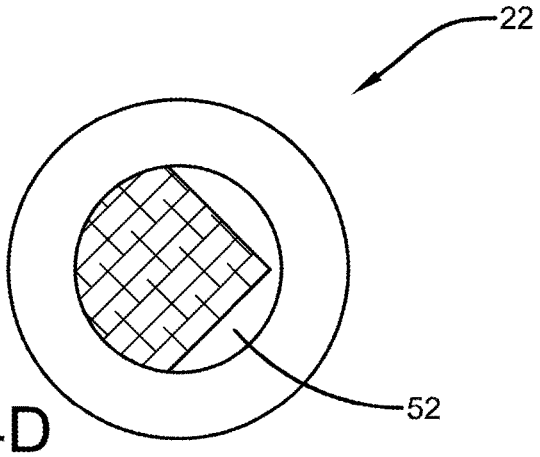

The control valve 22 shall be suitable for the pressure which it is subject to. The control valve 22 shall be selected with a proper flow coefficient (Cv) with the circulating pump 20 in operation. The control valve 22 shall operate at 24V and accept an input signal of 4-20 ma and provide a 4-20 ma feedback signal. The control valve 22 may be in the form of a V-port ball valve or other suitable valve. The V-port ball 52 (FIGS. 4B to 4D) of the control valve 22 may assume several positions to control the flow of water through the control valve 22 in response to certain situations. For example, FIG. 4A shows the control valve 22 in the fully open position (100 percent open), and FIG. 4B shows the control valve 22 in the fully closed position. FIG. 4C shows the control valve 22 in a position that is 33 percent open, and FIG. 4D shows the control valve 22 in a position that is 75 percent open.

The water supply and water return pressure sensors 30, 32 sense the pressure at the location where they are disposed. The pressure sensors may each be an EFECTOR MODEL PT that is manufactured by IFM. The range of each pressure sensor may be selected so that the operating pressure of the freeze protection system is at the midpoint of the span of the pressure sensor.

The air handling system 10 may comprise one or more air temperature sensors 54 (FIG. 3) for sensing the temperature of the global outdoor air. The air temperature sensor information indicates, or can be used to determine, that the temperature sensed by the air temperature sensor 54 has fallen below a threshold. The air temperature sensor 54 may be clamped or otherwise mounted or positioned on or near a conduit, or in other suitable indoor or outdoor location(s) exposed to the outdoor air temperature and prone to freezing. The air temperature sensor 54 may be implemented with suitable circuitry or devices, such as, for example, one or more thermistors and/or thermocouples.

The air handling system 10 may comprise a discharge temperature sensor 56 (FIG. 3) to sense the temperature of the water discharging at a pipe. The water return temperature sensor 28 senses the temperature of the water in the common water return pipe 18, and the water supply temperature sensor 26 senses the temperature in the common water supply pipe 16. The discharge temperature sensor 56, water return temperature sensor 28, and water supply temperature sensor 26 may be liquid insertion-type sensors and provide a 2-wire, 4-20 mA DC linear output over a specified temperature range.

The combination flow and temperature switch 34 may be suitable for liquids and gases. The combination temperature and flow switch 34 may be disposed in the common water return pipe 18 to sense the flow and temperature of the return water at that location. The combination flow and temperature switch 34 may have a medium temperature from 25° C. to 80° C. The combination flow and temperature switch 34 may have an operating voltage from 19 to 36 VDC. The combination flow and temperature switch 34 may provide two normally open/closed programmable switch functions. The combination flow and temperature switch 34 may have push buttons for adjustment of the switch point.

As illustrated in FIG. 3, the touch screen controller 24 may comprise an integrated programmable controller configured to control components of the air handling system 10 as per the sequence of operations. The controller 24 includes input/output logic, and communicates with terminals and other devices using three serial ports, a Controller Area Network (CANbus) port 58 and an Ethernet port 60. The controller 24 may include universal inputs/outputs configured to connect to temperature and pressure sensor probes, digital inputs, analog and Pulse-width modulation outputs for internal equipment.

The touch screen controller 24 may comprise a touch screen display 62. The display 62 may produce high resolution images. The touch screen display may display flow, temperature, and pressure values internal to the system. The touchscreen display 62 may also display the operating status of internal equipment. A graphical user interface (GUI) provides operational information to the user. The display may present real-time display of system status, alarm conditions, configuration options, network (web) status, and power status. The user interface may provide a number of keys, allowing the user to set the configuration and operation of each interface module, as well as various operational parameters of the motherboard. The controller 24 may include a microprocessor 64 and be provided with a BACNET, MODBUS, or LONWORKS interface 66. The controller may comprise a control box that contains the components of controller 24. Alternatively or in addition, a keypad may be provided on the controller for the user to operate.

As illustrated in FIG. 3, the various parameter sensors are operatively connected to the controller 24 for providing indicia representative of the operating condition of the air handling system 10, and for sensing different parameters of the operation of the air handling system 10. Generally, if the parameters either exceed or fall below some pre-established threshold, or indicates a condition related to a potential freezing condition of the coils, a signal is sent to the controller 24, which then operates to provide outputs indicative of the status of the air handling system operation, and, in addition, operates certain components of the freezing protection system 12. The sensors measure the inlet and outlet temperatures and pressures of the water in the coils 14, 15 at all ambient conditions and monitors the flow through the coils 14, 15 to ensure adequate tube velocity is maintained.

Specifically, the circulating pump 20, control valve 24, air temperature sensor 54, discharge temperature sensor 56, water return temperature sensor 28, water supply temperature sensor 26, temperature and flow switch 34, water return pressure sensor 32, water supply pressure sensor 30, alarm 68, and on/off switch 70 are operatively connected to the controller 24. The sensors and other components operatively connected to the controller may communicate via a wired connection to the controller. In other embodiments, one or more wireless sensors or other components can be employed to wirelessly communicate information to controller equipped for wireless communication. As illustrated by the arrows of FIG. 3, upon receipt of the signal information from the sensors or components, the controller 24 sends control signals to the designated component to perform an operation.

The components of the air handling system 10 are arranged and connected as follows. Referring to FIG. 1, a first water supply branch 72 is fluidly connected downstream to an inlet of the first coil 14, and a second water supply branch 74 is fluidly connected downstream to an inlet of the second coil 15. The first and second water supply pipe branches 72, 74 are fluidly connected upstream to the common water supply pipe 16. First and second shut off valves 76, 78 are connected in line of the first and second water supply pipe branches 72, 74, respectively. A first water return pipe branch 80 is fluidly connected upstream to an outlet of the first coil 14, and a second water return pipe branch 82 is fluidly connected upstream to an outlet of the second coil 15. The first and second water return pipe branches 80, 82 are fluidly connected downstream to the common water return pipe 18. First and second flow and temperature monitors 84, 86 are connected in line of the first and second water return branches 80, 82, respectively. Third and fourth shut off valves 88, 90 are connected in line of their respective first and second water return branches 80, 82 at a location downstream of their respective first and second flow and temperature monitors 84, 86. First and second ball valves 92, 94 with plugs for use as a manual air vent are also fluidly connected to their respective coils 14, 15. First and second drain valves 96, 98 with capped hose adapters may also be fluidly connected to their respective coils 14, 15.

As illustrated in FIG. 1, the housing 48 houses components of the freeze protection system 12 as previously mentioned and also portions of the common water return pipe 18 and the common water supply pipe 16. The flow and temperature switch 34 is connected in line of the common water return pipe 18 within the housing 48. The water return pressure sensor 32 is connected in line of the common water return pipe 18 and located downstream of the flow and temperature switch 34. The water return temperature sensor 28 is connected in line of the common water return pipe 18 and located downstream of the water return pressure sensor 32. The control valve 22 is connected in line of the common water return pipe 18 and located downstream of the water return temperature sensor 28. The water return shutoff valve 44 is connected in line of the common water return pipe 18 and located downstream of the control valve 22. The water supply shutoff valve 40 is connected in line of the common water supply pipe 16 within the housing 48. The balancing valve 36 is connected in line of the common water supply pipe 16 and located downstream of the water supply shut off valve 40. The strainer 38 with blow-off valve is connected in line of the common water supply pipe 16 and located downstream of the balancing valve 36. The strainer 38 may be comprised of a cast iron or bronze body with ample strength for the pressure to which it may be subjected to. The strainer 38 may be of such a design as to allow blowing out of accumulated dirt and to facilitate removal and replacement of a strainer screen, without disconnection of the main piping.

The water supply temperature sensor 26 is connected in line of the common water supply pipe 16 and located downstream of the strainer 38 with blow-off valve. The water supply pressure sensor 30 is connected in line of the common water supply pipe 16 and located downstream of the water supply temperature sensor 26. The circulating pump 20 is fluidly connected via its inlet to the common water return pipe 18 at a location between the water return temperature sensor 28 and the control valve 22. The output of the circulating pump 20 is fluidly connected through a check valve 100 and to the common water supply pipe 16 at a location between the water supply temperature sensor 26 and the strainer with blow-off valve 38. The circulating pump 20 operates to pump water from the common water return pipe 18 to the common water supply pipe 16 as indicated by the arrows of FIG. 1. The water supply drain valve 42 is fluidly connected to the common water supply pipe 16 at a location downstream of the water supply pressure sensor 30. Another water supply drain valve 42 may be fluidly connected to the common water supply pipe 16 at a location further downstream and outside of the housing 48. The water return drain valve 46 is fluidly connected to the common water return pipe at a location upstream of the temperature and flow switch 34. Another water return drain valve 46 may be fluidly connected to the common water return pipe 18 at a location further upstream and outside of the housing 48. The drain valves 42, 46 may be capped with hose adapters.

Figure 2:
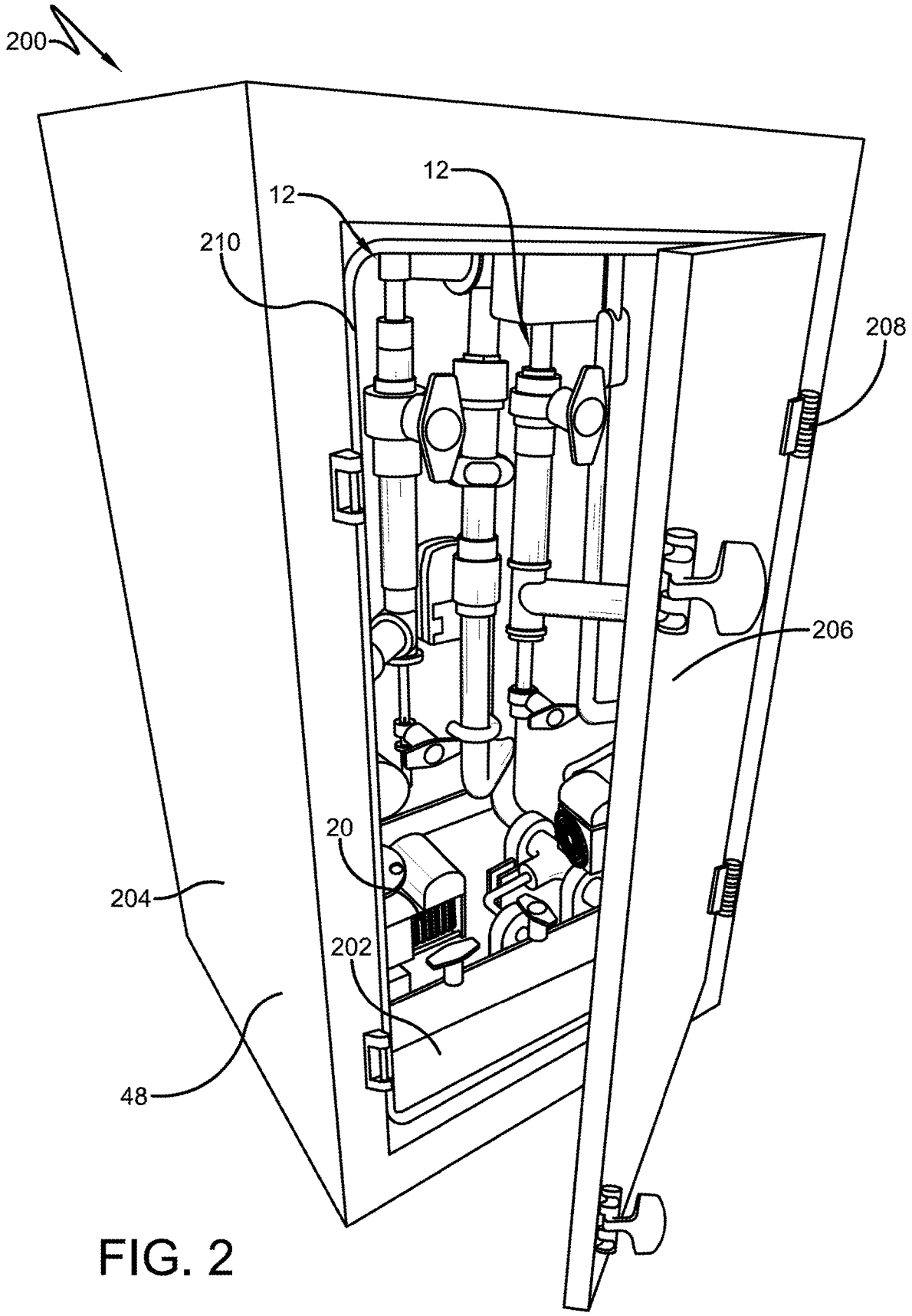
FIG. 2 is a perspective view of the freeze protection unit of the air handling system of FIG. 1.

FIG. 2 illustrates a factory packaged unit 200 containing the components of two freeze protection systems 12 that may be retrofitted to or installed with the air handling system(s). Alternatively, the unit may contain the components of one freeze protection system that may be retrofitted to or installed with the air handling system as illustrated in FIG. 1. The housing 48 of the freeze protection unit 200 may be constructed of double wall foam panels with the inside walls 202 being made of 24 gauge galvanized steel, and the outside walls 204 being 24 gauge powder coated steel. The thermal resistance or R-value on the walls may be R–6.5. The freeze protection unit may be configured for floor mounting. The freeze protection unit 200 may also be provided with wall mounting brackets. Each freeze protection system in the unit shall be subjected to a hydrostatic pressure test at least 1½ times the maximum operating pressure (but not less than 100 psi) for a minimum of four hours to detect all leaks and defects. The freeze protection unit 200 passes the test if there is no drop in pressure.

The freeze protection unit 200 shall be provided with a side access doors 206 of the same construction as the cabinet 48. The access doors 206 may be provided with dual hinges 208 which allow either right or left handed door swinging, or completely door removal, for increased serviceability. The entire door opening shall be provided with an automotive style bulb gasket 210. The hinges 208 may be of the lockable type.

Figure 5:
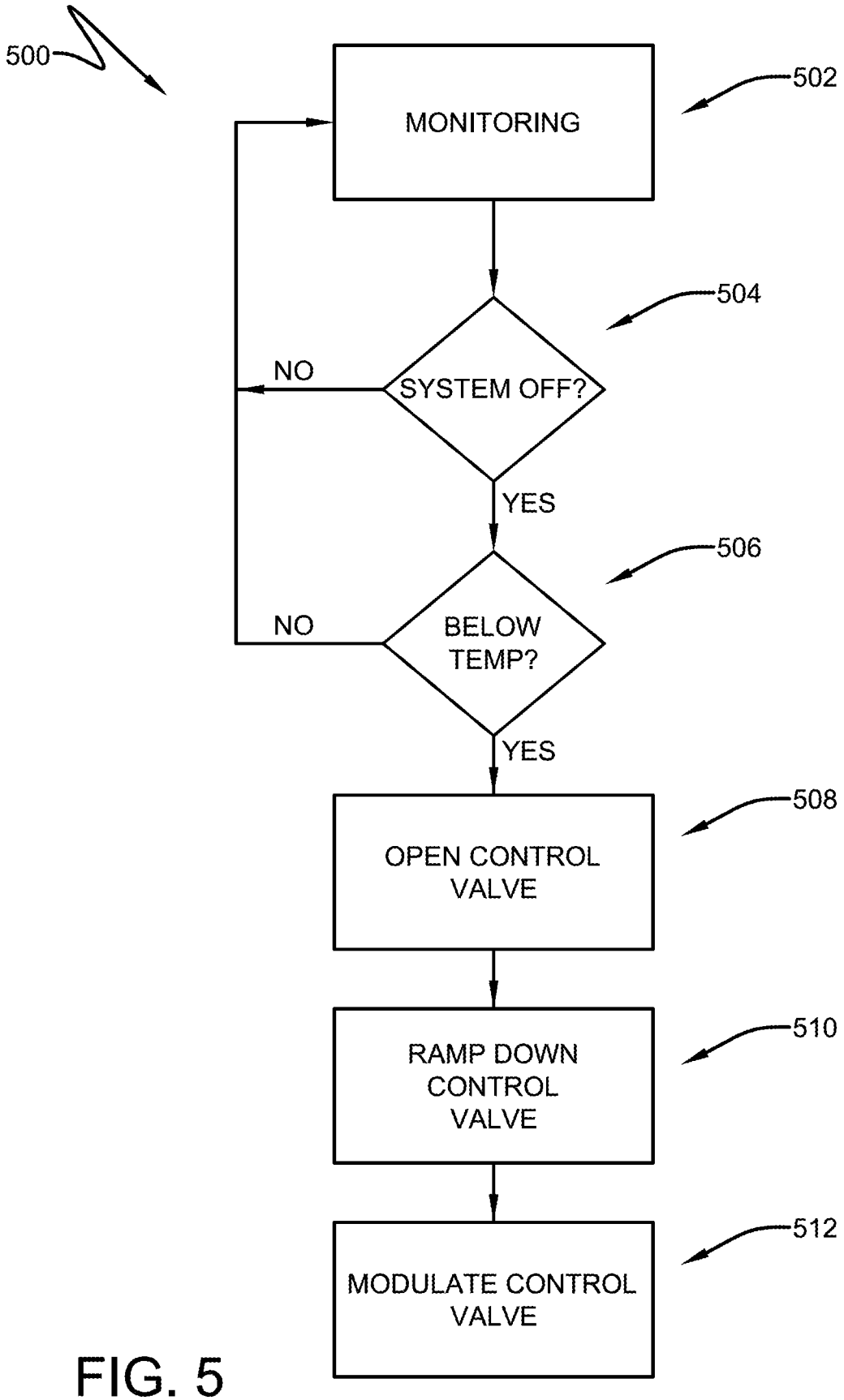
FIG. 5 is a flow diagram of one process of a method for operating the freeze protection of the air handling unit of FIG. 1.
Figure 6:
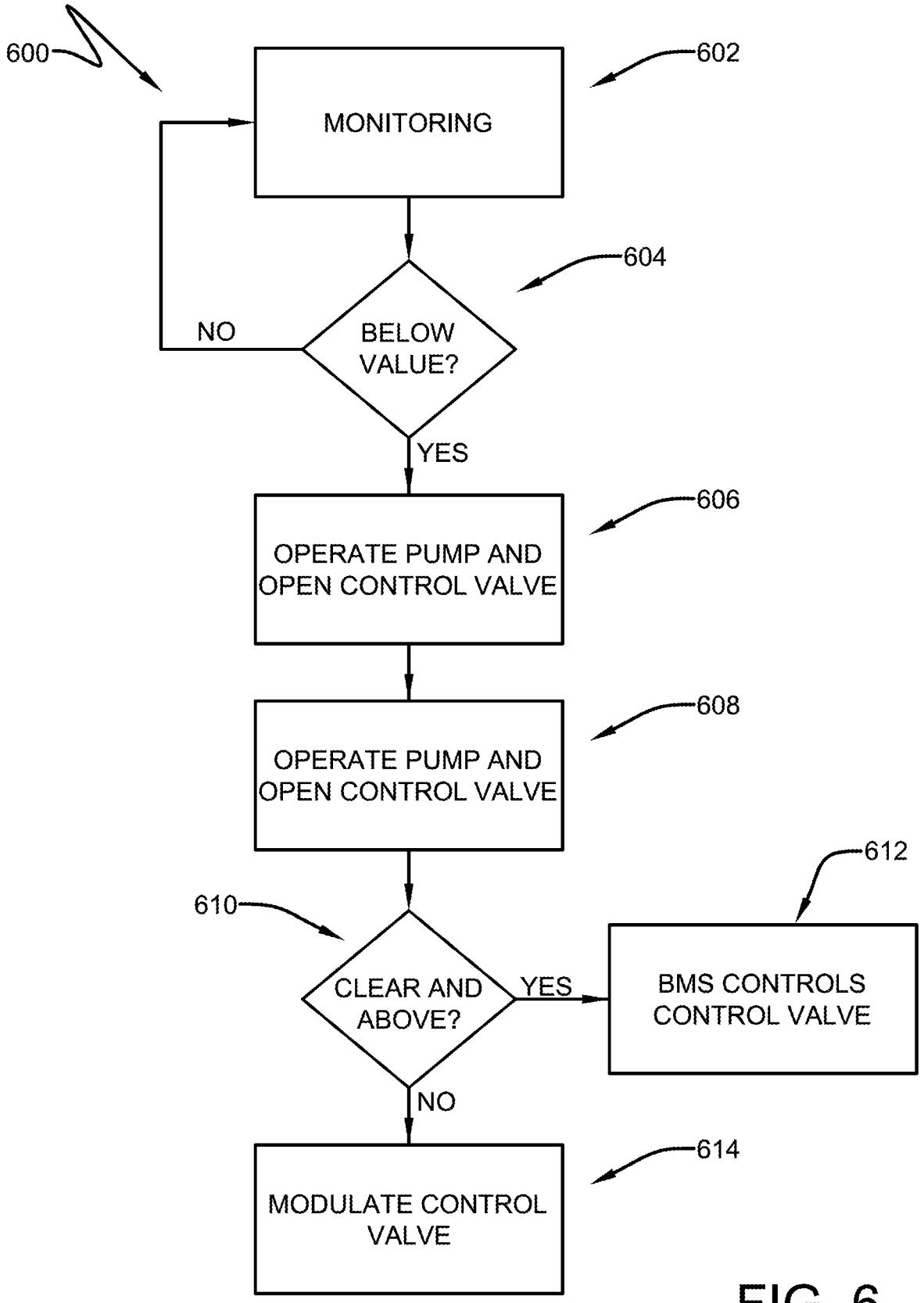
FIG. 6 is a flow diagram of another process of a method for operating the freeze protection of the air handling unit of FIG. 1.

FIGS. 5 and 6 illustrate the method of operating the freeze protection system 12. FIG. 5 illustrates one process 500 of the method of operating the freeze protection system 12. Referring to FIG. 5, the process 500 begins in step 502 with the controller 24 monitoring the air handling system 10. In step 504, the controller 24 receives information from the on/off switch 70 or other suitable device(s) that detects whether the heating and ventilation unit is turned off, commanded off, or transitioned from off to on and determines whether the heating and ventilation unit is turned off, commanded off, transitioned from off to on, or shut off by the fire alarm system. If the controller 24 does not determine that the heating and ventilation unit is off, commanded off, transitioned from off to on, or shut off by the fire alarm system, then the process goes back to step 502. If the controller 24 determines that the heating and ventilation unit is off, commanded off, transitioned from off to on, or shut off by the fire alarm system, then the process goes to step 506. In step 506, the controller 24 receives information from one or more air temperature sensors 54 or the discharge temperature sensor 56 and determines whether either the air temperature sensor(s) 54 or the discharge temperature sensor 56 senses a temperature below a first predetermined temperature indicative of a potential freezing condition such as, for example, 35 degrees Fahrenheit. If neither the global outdoor air temperature sensor(s) nor the discharge temperature sensor senses a temperature below the first predetermined temperature, then the process goes back to step 502.

If either the global outdoor air temperature sensor(s) 54 or the discharge temperature sensor 56 sense a temperature below the first predetermined temperature, then the process goes to step 508. In step 508, the controller 24 sends a control signal to the control valve 22 that immediately places the control valve in a position in which the control valve is 33 percent opened as seen in FIG. 4C. Alternatively, the freeze protection system 12 may be configured such that the control valve 22 may be placed in a position other than 33 percent opened, such as positions more than 0 percent opened but less than 50 percent opened. Then in step 510, in response to information received from the water return temperature sensor 28, the controller 24 causes the control valve 22 to ramp down slowly until the water return temperature sensor 28 senses a temperature of the return water at a water return temperature set point. In step 512, in response to information received from the water return temperature sensor 28, the controller 22 sends control signals to the control valve 22 to cause the control valve 22 to modulate to maintain the temperature of the water in the common water return pipe 18 at the set point. The common return water temperature set point may be 50 degrees Fahrenheit.

FIG. 6 shows another process 600 of the method of operating the freeze protection system 12. Referring to FIG. 6, the process 600 begins in step 602 with the controller 24 monitoring the air handling system 10. In step 604, the controller 24 receives information sensed from the combination temperature and flow switch 34 on the common water return pipe 18 from each coil and determines whether the flow of water through the common water return pipe 18 is less than a predetermined amount or value, such as 1 ft/s, or whether the water in the common return pipe 18 is less than a second predetermined value, such as 40 degrees Fahrenheit. If the flow of water through the common water return pipe 18 is not less than the predetermined amount or the temperature of the water in the common water return pipe 18 is not less than the second predetermined value, then the process goes back to step 602. If the flow of water through the common water return pipe 18 is less than a predetermined amount or the temperature of the water in the common water return pipe 18 is less than the second predetermined value, then the process goes to step 606. In step 606, the controller 24 sends a control signal to the circulating pump 20 to immediately operate the circulating pump 20 to flow preheated hot water, and also sends a control signal to the control valve 22 to cause the control valve 22 to immediately be placed in a position such that the control valve 22 is 75% opened as shown in FIG. 4D. Alternatively, the freeze protections system may be configured such that the control valve 22 may be placed in a position other than 75 percent opened, such as positions less than 100 percent opened but more than 50 percent opened. Also, in step 608, the controller 24 sends a control signal to activate the alarm 68 at a workstation.

In step 610, the controller 24 determines whether each of the flow and temperature switch alarms clear (the flow of water is not less than the predetermined amount and the water temperature in the common water return pipe is not less than a predetermined value) and also whether the water temperature in the common water return pipe 18 is above the common return water temperature set point (e.g. 50 degrees Fahrenheit). If each of the flow and temperature switch alarms clear and the water temperature in the common water return pipe 18 is above the common return water temperature set point, the control valve 22 shall relinquish control to the building management system (BMS) at step 612. If this condition is not met, then the control valve 22 shall modulate to maintain the main return water temperature set point at step 614.

As the control valve 22 opens and modulates in the processes shown in FIGS. 5 and 6, the pressure drop and flow to the coil increase. However, both the pressure drop and the flow to the coils remain within an acceptable range to maintain control of the air handling system 10 and allow the control valve 22 to maintain authority both when the air handling system 10 is operating and not operating as well as throughout all other modes of operation of the air handling system 10. The CV of the control valve 22 is selected to allow the control valve 22 to maintain authority throughout all modes of operation of the air handling system 10. Also, the circulating pump 20 is sized by selecting the flow and head to maintain the tube velocity at 1 fps, without any system pump input flow.

Figure 7A:
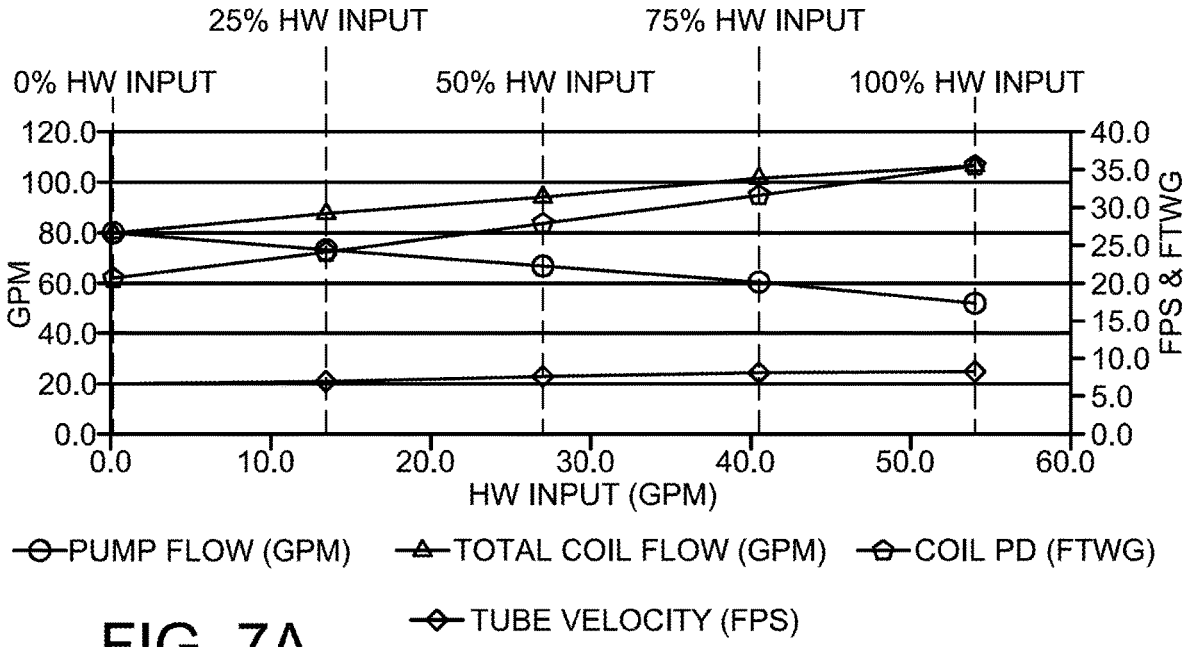
FIG. 7A is a graph of parameters of a known air handling system that has a typical freeze protection system using a pump.
Figure 7B:
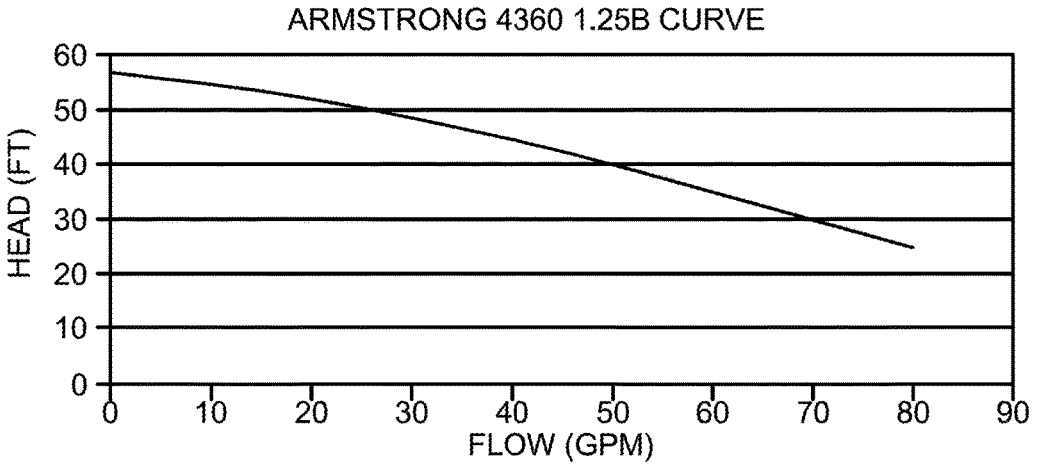
FIG. 7B is a graph of the head versus flow of a pump in the freeze protection system of FIG. 7A.

FIGS. 7A and 7B show graphs of operating parameters in a known example air handling system that has a typical freeze protection system using a pump. Because there a different sizes of circulator pumps no pump will be perfectly sized for your application. To compensate, the larger pump is typically selected to provide enough water flow. With a pump that is selected to exceed design flow and head, in unoccupied mode the pump will follow its pump curve and deliver more flow than the coil requires. As you move into occupied mode and your valve opens, the pressure drop increases on the second order curve, your tube velocity exceeds acceptable standards and your control valve requires more system pressure not to lose authority.

Figure 8A:
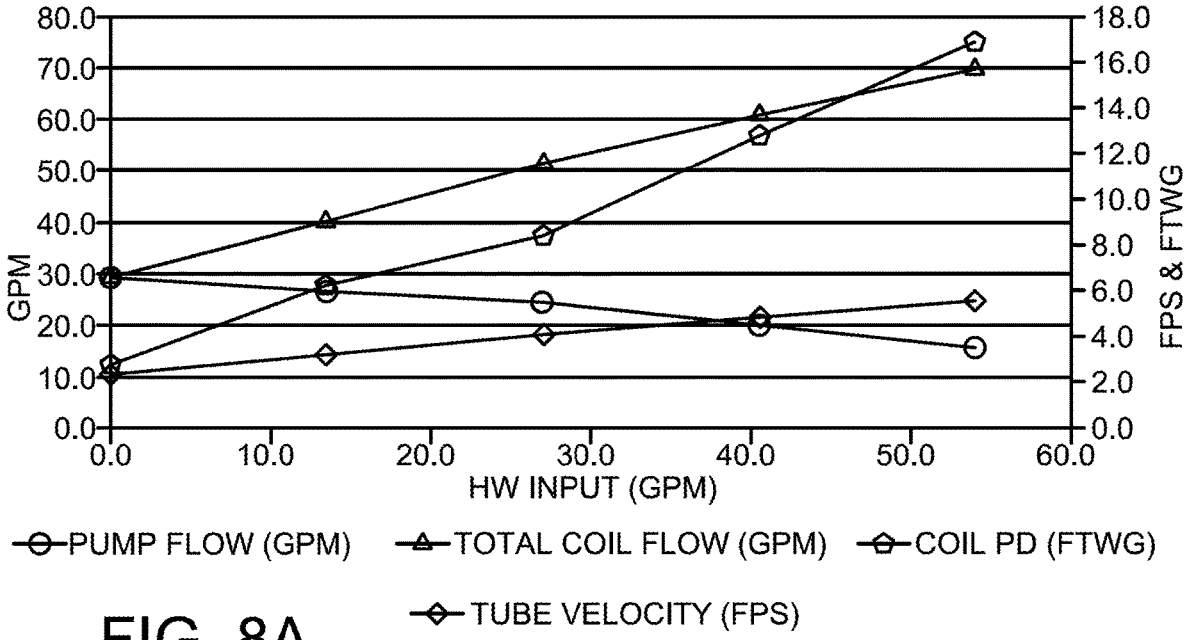
FIG. 8A is a graph of parameters of the air handling system with the freeze protection system according to the embodiment of FIG. 1.
Figure 8B:
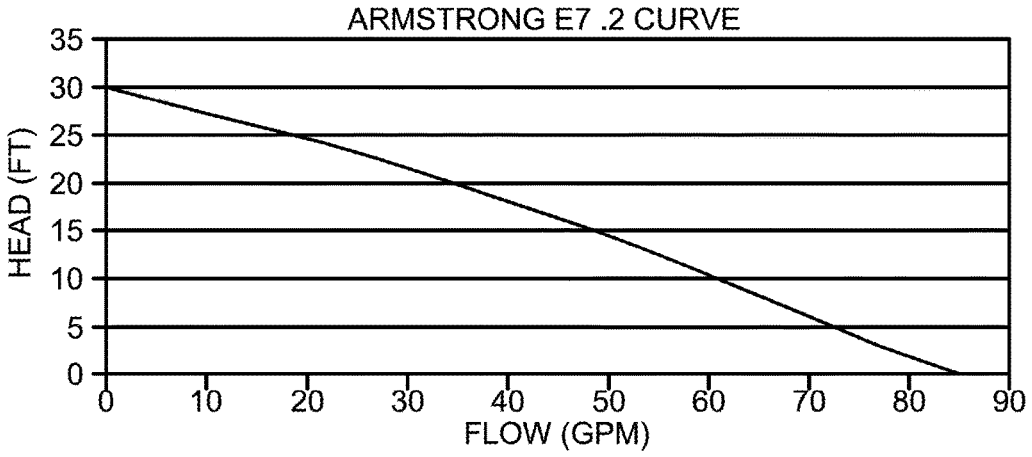
FIG. 8B is a graph of the head versus flow of a pump in the freeze protection system of FIG. 8A.

FIGS. 8A and 8B are graphs of the operating parameters of the air handling system 10 with the freeze protection system 12 according to an exemplary embodiment of the present invention. As illustrated, the freeze protection system 12 reduced the flow and pressure drop of the circulating pump 20 when the control valve 22 is closed while maintaining a higher than 1 fps tube velocity by providing a right sized pump 20. As the control valve 22 opens and modulates, the pressure drop and flow to the coil increase however they stay within an acceptable range to maintain control of the air handling system 10 and allow the control valve 22 to maintain authority both when the air handling system 10 is operating and not operating as well as throughout all other modes of operation of the air handling system. The CV of the control valve 22 is selected to allow the control valve 22 to maintain authority throughout all modes of operation.

The freeze protection system 12 protects the coil from freezing and has the following advantages. The circulating pump 20 is sized by selecting the flow and head to maintain the tube velocity at 1 fps, without any system pump input flow. The water temperature and other temperatures in the loop of the freeze protection system 12 is monitored instead of just the ambient or outside air temperature. Proper fluid velocity is maintained to avoid freezing. Multiple points are measure in the system to check for a freezing condition. The factory packaged freeze protection unit 200 eliminates field installation errors. The factory calculated pressure drop of the freeze protection loop provides a better system design. Monitoring the water temperature to control the control valve 22 ensures more accurate freeze potential detection. The pump 20 is sized correctly with regards to the total pressure drop of the freeze protection loop. The proper tube velocity is maintained to be above 1 fps and below 8 fps. The CV of the control valve 22 enables minimum system differential pressure, thereby allowing the control valve to maintain authority and for the air handler to deliver the proper air temperature.

Although various embodiments of the disclosed system and method for freeze protection of an air handling system have been shown and described, modifications may occur to those skilled in the art upon reading the specification. The present application includes such modifications and is limited only by the scope of the claims.

What is claimed is:

1. An air handling system comprising:

at least one coil;

a water supply piping system in fluid communication with the at least one coil for supplying water to the at least one coil;

a water return piping system in fluid communication with the at least one coil and water supply piping system for returning the water from the at least one coil to the water supply piping system;

a circulating pump, wherein the circulating pump is in operative fluid communication with the water supply piping system and the water return piping system;

a control valve, wherein the control valve is disposed in the water return piping system, wherein the control valve is configured for controlling the flow of water;

a first temperature sensor, wherein the first temperature sensor is configured for sensing temperature at a location;

a water return temperature sensor, wherein the water return temperature sensor is configured for sensing the temperature of the return water in the water return piping system;

a controller, wherein the controller is in operative connection with the first temperature sensor and the control valve, wherein the controller is in operative connection with the water return temperature sensor; and wherein the controller is configured to cause the control valve to open to a first predetermined position that is less than a fully opened position in response to the first temperature sensor sensing a temperature below a first predetermined value and then have the control valve ramp down until the water return temperature sensor senses a temperature of the return water at a water return temperature set point such that the pressure drop in the at least one coil and flow to the at least one coil increases at sufficient values to protect against freezing of the water in the at least one coil while also staying within a sufficient range to maintain authority of the control valve when the air handling system is either operating or not operating.

2. The air handling system of claim 1, wherein the first predetermined position of the control valve is less than 50 percent open.

3. The air handling system of claim 1, wherein the first predetermined position of the control valve is 33 percent open.

4. The air handling system of claim 1 further comprising a discharge temperature sensor, wherein the discharge temperature sensor is configured for sensing the temperature of air being discharged from the air handling system, wherein the controller is in operative connection with the discharge temperature sensor, wherein the first temperature sensor is an air temperature sensor, wherein the air temperature sensor is configured for sensing the temperature of air, wherein the controller is configured to cause the control valve to open to the first predetermined position in response to one of the air temperature sensor and the discharge temperature sensor or both the air temperature sensor and the discharge temperature sensor sensing a temperature below the first predetermined value and then have the control valve ramp down until the water return temperature sensor senses the temperature of the return water below the water return temperature set point.

5. The air handling system of claim 1, wherein the first predetermined temperature is 35 degrees Fahrenheit and the water return temperature set point is 50 degrees Fahrenheit.

6. The air handling system of claim 1 further comprising a flow sensor, wherein the flow sensor is disposed in the water return piping system, wherein the flow sensor is configured for sensing the flow of water through the water return piping, wherein the controller is in operative connection with the flow sensor and the circulating pump, wherein the controller is configured to cause the circulating pump to operate in response to the flow sensor sensing a flow that is less than a predetermined flow value.

7. The air handling system of claim 6, wherein the controller is configured to cause the control valve to open the control valve to a second predetermined position that is less than a fully opened position in response to the flow sensor sensing a flow that is less than a predetermined flow value.

8. The air handling system of claim 1 further comprising a combination flow and temperature switch, wherein the flow and temperature switch is disposed in the water return piping system, wherein the flow and temperature switch is configured for sensing the temperature and flow of water through the water return piping system, wherein the controller is in operative connection with the flow and temperature switch and the circulating pump, wherein the controller is configured to cause the circulating pump to operate in response to the flow and temperature switch sensing one of a flow that is less than a predetermined flow value and a temperature of the water through the return water piping system that is less than a second predetermined value or both a flow that is less than the predetermined flow value and a temperature of the water through the water return piping system that is less than the second predetermined value.

9. The air handling system of claim 8 including an alarm, wherein the controller is in operative connection with the alarm, wherein the controller sends a control signal to the alarm to activate the alarm in response to the flow and temperature switch sensing one of a flow that is less than the predetermined flow value and a temperature of the water through the water return piping system that is less than the second predetermined value or both a flow that is less than the predetermined flow value and a temperature of the water through the water return piping system that is less than the second predetermined value.

10. The air handling system of claim 8, wherein the controller is configured to cause the control valve to open to a second predetermined position that is more than 50 percent open in response to the flow and temperature switch sensing a flow that is less than the predetermined flow value.

11. The air handling system of claim 1, wherein the control valve is ramped down until the water return temperature sensor senses a temperature of the return water at a water return temperature set point slower than the control valve opens to a first predetermined position that is less than a fully opened position in response to the first temperature sensor sensing a temperature below a first predetermined value.

12. The air handling system of claim 11, wherein the controller causes the control valve to modulate to maintain the temperature of the return water in the water return piping system at the water return temperature set point.

13. The air handling system of claim 1, wherein the controller causes the control valve to modulate to maintain the temperature of the return water in the water return piping system at the water return temperature set point.

14. The air handling system of claim 13, wherein the controller causes the control valve to modulate such that the pressure drop in the at least one coil and flow to the at least one coil increases at sufficient values to protect against freezing of the water in the at least one coil while also staying within a sufficient range to maintain authority of the control valve when the air handling system is either operating or not operating.

15. The air handling system of claim 1, wherein the controller is configured to cause the control valve to open to a first predetermined position that is less than a fully opened position in response to the first temperature sensor sensing a temperature below a first predetermined value and then have the control valve ramp down until the water return temperature sensor senses a temperature of the return water at a water return temperature set point such that the pressure drop in the at least one coil and flow to the at least one coil increases at sufficient values to protect against freezing of the water in the at least one coil while also staying within a sufficient range to maintain authority of the control valve when the air handling system is off or commanded off or transitioned from off to on.

16. A freeze protection system for an air handling system comprising:

a water supply piping system for supplying water to at least one coil of the air handling system;

a water return piping system in fluid communication with the water supply piping system for returning the water from the at least one coil to the water supply piping system;

a circulating pump, wherein the circulating pump is in operative fluid communication with the water supply piping system and the water return piping system;

a control valve, wherein the control valve is disposed in the water return piping system, wherein the control valve is configured for controlling the flow of water;

a first temperature sensor, wherein the first temperature sensor is configured for sensing temperature at a location;

a water return temperature sensor, wherein the water return temperature sensor is configured for sensing the temperature of the return water in the water return piping system;

a controller, wherein the controller is in operative connection with the first temperature sensor and the control valve, wherein the controller is in operative connection with the water return temperature sensor; and wherein the controller is configured to cause the control valve to open to a predetermined position that is less than a fully opened position in response to the first temperature sensor of the air handling system sensing a temperature at the location below a first predetermined value and then have the control valve ramp down until the water return temperature sensor senses a temperature of the return water at a water return temperature set point such that the pressure drop in the at least one coil and flow of water to the at least one coil increases at sufficient values to protect against freezing of the water in the at least one coil while also staying within a sufficient range to maintain authority of the control valve when the air handling system is either operating or not operating or transitioned from not operating to operating.

17. The freeze protection system of claim 16 further comprising a combination flow and temperature switch, wherein the flow and temperature switch is disposed in the water return piping system, wherein the flow and temperature switch is configured for sensing the temperature and flow of water through the water return piping system, wherein the controller is in operative connection with the flow and temperature switch and the circulating pump, wherein the controller is configured to cause the circulating pump to operate in response to the flow and temperature switch sensing one of a flow that is less than a predetermined flow value and a temperature of the water through the return water piping system that is less than a second predetermined value or both a flow that is less than the predetermined flow value and a temperature of the water through the water return piping system that is less than the second predetermined value.

18. The freeze protection system of claim 16 further comprising a housing, wherein the housing houses a portion of the water supply piping system, a portion of the water return piping system, the circulating pump, the control valve, and the controller, wherein the housing includes an access door for enabling access to components of the freeze protection system.

19. The freeze protection system of claim 16 further comprising at least one pressure sensor disposed in one of the water supply piping system and the water return piping system, wherein the at least one pressure sensor is configured for sensing the pressure of the water.

20. A freeze protection system for an air handling system comprising:

a water supply piping system for supplying water to at least one coil of the air handling system;

a water return piping system in fluid communication with the water supply piping system for returning the water from the at least one coil to the water supply piping system;

a circulating pump, wherein the circulating pump is in operative fluid communication with the water supply piping system and the water return piping system;

a control valve, wherein the control valve is disposed in the water return piping system, wherein the control valve is configured for controlling the flow of water;

a first temperature sensor, wherein the first temperature sensor is configured for sensing temperature at a location;

a controller, wherein the controller is in operative connection with the first temperature sensor and the control valve;

wherein the controller is configured to cause the control valve to open to a predetermined position that is less than a fully opened position and modulate in response to the first temperature sensor sensing a temperature at the location below a first predetermined value such that the pressure drop in the at least one coil and flow of water to the at least one coil increases at sufficient values to protect against freezing of the water in the at least one coil while also staying within a sufficient range to maintain authority of the control valve when the air handling system is either operating or not operating; and a combination flow and temperature switch, wherein the flow and temperature switch is disposed in the water return piping system, wherein the flow and temperature switch is configured for sensing the temperature and flow of water through the water return piping system, wherein the controller is in operative connection with the flow and temperature switch and the circulating pump, wherein the controller is configured to cause the circulating pump to operate in response to the flow and temperature switch sensing one of a flow that is less than a predetermined flow value and a temperature of the water through the return water piping system that is less than a second predetermined value or both a flow that is less than the predetermined flow value and a temperature of the water through the water return piping system that is less than the second predetermined value.

21. A freeze protection system for an air handling system comprising:

a water supply piping system for supplying water to at least one coil of the air handling system;

a water return piping system in fluid communication with the water supply piping system for returning the water from the at least one coil to the water supply piping system;

a circulating pump, wherein the circulating pump is in operative fluid communication with the water supply piping system and the water return piping system;

a control valve, wherein the control valve is disposed in the water return piping system, wherein the control valve is configured for controlling the flow of water;

a first temperature sensor, wherein the first temperature sensor is configured for sensing temperature at a location;

a controller, wherein the controller is in operative connection with the first temperature sensor and the control valve;

wherein the controller is configured to cause the control valve to open to a predetermined position that is less than a fully opened position and modulate in response to the first temperature sensor sensing a temperature at the location below a first predetermined value such that the pressure drop in the at least one coil and flow of water to the at least one coil increases at sufficient values to protect against freezing of the water in the at least one coil while also staying within a sufficient range to maintain authority of the control valve when the air handling system is either operating or not operating; and a housing, wherein the housing houses a portion of the water supply piping system, a portion of the water return piping system, the circulating pump, the control valve, and the controller, wherein the housing includes an access door for enabling access to components of the freeze protection system.

22. A freeze protection system for an air handling system comprising:

a water supply piping system for supplying water to at least one coil of the air handling system;

a water return piping system in fluid communication with the water supply piping system for returning the water from the at least one coil to the water supply piping system;

a circulating pump, wherein the circulating pump is in operative fluid communication with the water supply piping system and the water return piping system;

a control valve, wherein the control valve is disposed in the water return piping system, wherein the control valve is configured for controlling the flow of water;

a first temperature sensor, wherein the first temperature sensor is configured for sensing temperature at a location;

a controller, wherein the controller is in operative connection with the first temperature sensor and the control valve;

wherein the controller is configured to cause the control valve to open to a predetermined position that is less than a fully opened position and modulate in response to the first temperature sensor sensing a temperature at the location below a first predetermined value such that the pressure drop in the at least one coil and flow of water to the at least one coil increases at sufficient values to protect against freezing of the water in the at least one coil while also staying within a sufficient range to maintain authority of the control valve when the air handling system is either operating or not operating; and at least one pressure sensor disposed in one of the water supply piping system and the water return piping system, wherein the at least one pressure sensor is configured for sensing the pressure of the water.

23. A method for protecting against freezing of a coil of an air handling system comprising:

providing a water supply piping system in fluid communication with the coil for supplying water to the coil;

providing a water return piping system in fluid communication with the coil and water supply piping system for returning the water from the coil to the water supply piping system;

providing a circulating pump in operative fluid communication with the water supply piping system and the water return piping system;

sensing a first temperature at a location using a first temperature sensor;

sensing a second temperature of the return water in the water return piping system using a water return temperature sensor;

determining whether the sensed first temperature is below a first predetermined value;

in response to determining that the sensed first temperature is below a first predetermined value, opening a control valve associated with the coil to a first predetermined position that is less than a fully opened position and;

ramping down the control valve until the sensed second temperature of the return water is at a water return temperature set point such that the pressure drop in the coil and flow of water to the coil increases at sufficient values to protect against freezing of the water in the coil while also staying within a sufficient range to maintain authority of the control valve when the air handling system is either operating or not operating.

24. The method of claim 23 further comprising:

determining whether the air handling system is not operating or transitioned from not operating to operating; and wherein ramping down the control valve until the sensed second temperature of the return water is at a water return temperature set point such that the pressure drop in the coil and flow of water to the coil increases at sufficient values to protect against freezing of the water in the coil while also staying within a sufficient range to maintain authority of the control valve when the air handling system is either not operating or transitioned from not operating to operating.

25. The method of claim 23 further comprising:

sensing the flow of water through the water return piping system;

determining whether the sensed flow is below a predetermined flow value; and operating the circulating pump to pump water through the coil in response to the sensed flow being below the predetermined flow value.

26. The method of claim 25 further comprising:

opening the control valve to a second predetermined position that is less than a fully opened position in response to the sensed flow being below the predetermined flow value.

27. The method of claim 23 further comprising:

operating the circulating pump to pump water through the coil in response to the sensed second temperature of the water through the water return piping system being below a second predetermined value.

* * * * *